US008003291B2

(12) United States Patent
Almog et al.

(10) Patent No.: US 8,003,291 B2
(45) Date of Patent: Aug. 23, 2011

(54) METHOD OF CHARGING TONER PARTICLES

(75) Inventors: Yaacov Almog, Nes Ziona (IL); Avi Koller, Toronto (CA); Ilya Taraniuk, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 663 days.

(21) Appl. No.: 11/688,709

(22) Filed: Mar. 20, 2007

(65) Prior Publication Data

US 2008/0063973 A1 Mar. 13, 2008

Related U.S. Application Data

(63) Continuation-in-part of application No. PCT/IL2004/000871, filed on Sep. 20, 2004.

(51) Int. Cl.
*G03G 9/12* (2006.01)

(52) U.S. Cl. ..... 430/137.22; 430/137.19

(58) Field of Classification Search ..... 430/137.19, 430/137.22

See application file for complete search history.

(56) References Cited

U.S. PATENT DOCUMENTS

| | | | |
|---|---|---|---|
| 4,783,388 | A | 11/1988 | El-Sayed et al. |
| 5,563,015 | A | 10/1996 | Bonsignore et al. |
| 5,789,133 | A | 8/1998 | Yabuuchi et al. |

FOREIGN PATENT DOCUMENTS

| | | |
|---|---|---|
| EP | 0456177 | 11/1991 |
| JP | 59213428 | 12/1984 |
| JP | 2000284546 | 10/2000 |

OTHER PUBLICATIONS

International Search Report; 3 pages.
Notification of Transmittal of the International Searching Authority. 3 pages.
Written Opinion of the International Search Authority; 4 pages.

*Primary Examiner* — Hoa V Le

(57) ABSTRACT

A method of charging toner particles in a liquid toner comprising:

mixing the toner with an acid; and mixing the toner with a base that reacts with the acid to charge the toner particles.

23 Claims, No Drawings

METHOD OF CHARGING TONER PARTICLES

This patent application is a continuation-in-part under 35 U.S.C.§120 of PCT application serial number PCT/IL2004/000871, titled "A METHOD OF CHARGING TONER PARTICLES", filed on Sep. 20, 2004, which designated the United States, and is commonly assigned herewith, and hereby incorporated by reference.

FIELD OF THE INVENTION

The present invention relates to the process of producing liquid toners for use in electrostatic printing and in particular to charging toner particles comprised in the toner.

BACKGROUND OF THE INVENTION

To print an image on a substrate, a typical "electrostatic" digital printer first forms a copy of the image, conventionally referred to as a "latent image", on a photosensitive surface of a cylindrical roller, hereinafter referred to as a "photosensitive imaging plate" (PIP). To form the latent image a charger deposits a substantially uniform charge density on the photosensitive surface. The latent image is then formed by a laser that scans the charged photosensitive surface and discharges regions thereon to generate a pattern of charged and discharged or partially discharged pixels on the photosensitive surface that replicates the image to be printed. A developer develops the latent image by applying ink or toner, hereinafter generically, toner, to the photosensitive surface. The toner comprises charged toner particles of a desired color, which in an electrophoretic process migrate and adhere to the charged or the discharged or partially discharged pixels. The toner on the PIP is then optionally transferred from the PIP to a suitable transfer surface of another roller, conventionally referred to as an "intermediate transfer member" (ITM). The toner is transferred from the ITM to the substrate to print the image when the substrate passes through a nip between the ITM and an impression roller. In some cases the toner is transferred directly from the PIC to the substrate without an intermediate transfer via the ITM.

In many printing processes the toner is a liquid toner comprising charged toner particles dispersed in a non-polar carrier liquid having a relatively high electrical resistance. The toner particles generally comprise a polymer in which, optionally, a pigment is dispersed, and a charge control agent, often an organic salt, which provides a net charge in and/or on the toner particles. In order for the toner particles to be properly electrophoretically transferred and adhered to the PIP, the toner particles are charged with an amount of charge that endows them with an appropriate mobility through the carrier liquid, when subjected to an electric field.

Toner particles in a liquid toner are generally charged by adding to the particles at least one charge control agent, alternatively referred to as a "charge director" (CD), which is usually an organic salt. The salt bonds to the toner particles, generally to the polymer in the particles and either an anion or a cation separates from the bonded portion of the salt, leaving the toner particles charged with the charge of the cation or the anion.

A charge priming agent or charge adjuvant (CA), which promotes charging of the toner particles by a charge director is also often added to the particles. For liquid toners, aluminum alkoxide, an oxide such as silica, or a metallic soap, for example, aluminum or magnesium stearate or octoate, are commonly used as a charge adjuvant.

U.S. Pat. Nos. 4,794,651 and 5,565,299 describe materials and processes for preparing a liquid toner. U.S. Pat. Nos. 4,707,429 and 5,225,306 describe materials and processes for preparing a liquid toner using an aluminum stearate charge adjuvant and aluminum alkoxide charge priming agent. U.S. Pat. No. 5,573,882 describes materials and processes for preparing a liquid toner using a charge adjuvant. U.S. Pat. No. 5,393,635 describes a negative charge director for liquid electrographic toners in which a negative charge is generated by a weakly associating charged functional group covalently bonded to the resin of the toner particles and a very strongly chelating molecule dispersed in the liquid phase to achieve charge separation. The disclosures of all the aforementioned US patents are incorporated herein by reference.

SUMMARY OF THE INVENTION

An aspect of some embodiments of the invention, relates to a method of producing a liquid toner in which the toner particles exhibit enhanced charge relative to prior art toner particles.

In accordance with an aspect of some embodiments of the invention, toner particles in a liquid toner are charged with a negative charge by adding to the toner an acid and a base that react on or in the toner particles to charge them. The acid and base are typically an acid and base that combine to form a salt that can function as a charge control agent.

In some embodiments of the invention, the toner particles comprise a polymer having carboxylic acid moieties and the acid used to form the CD is optionally a sulfonic acid.

In accordance with an embodiment of the invention the toner particles are treated first with the acid and subsequently with the base to charge the particles.

Optionally, the acid is chosen form the group of acids consisting of dodecyl benzene sulfonic acid (DDBS), sodium bis(2-ethylhexyl)sulfosuccinate acid (AOT) and dinonyl naphthalene sulfonic acid (DNNS).

In some embodiments of the invention, the base is an amine, such as diethyl amine, or triethyl amine, of a group of amines characterized by various lengths of the hydrocarbon chain and various solubilities in the toner carrier liquid. In some embodiments of the invention, the base is a base of a bivalent metallic cation such as, basic barium petronate (BBP). In some embodiments of the invention the base is barium dinonyl naphthalene sulfonate hydroxide salt (DNNS BaOH).

The inventors have found that charging toner particles in a liquid toner by first adding an acid to the toner and stirring to percolate the acid with the toner particles and subsequently adding a base and stirring, generally results in the toner particles acquiring substantially more charge than they acquire by percolating the toner with a same amount of a salt that is the reaction product of the acid and base.

Salt molecules conventionally used as charge directors (CDs) for charging toner particles with a negative charge are often relatively large molecules that have a bipolar charge distribution characterized by relatively localized charge concentrations. The inventors believe that because of their relatively large size and relatively large dipole moment (generated by the ionic bond between the substituted amine (or other) base and substituted sulfonic (or other) acid comprised in the salts) these salt molecules tend to be respectively sterically and electrostatically hindered from attaching to the toner particles. As a result, charging of the toner particles by the molecules tends to be hampered.

On the other hand, an acid from which the salt may be prepared by neutralization with a base is generally much smaller than the resultant salt and has a more delocalized charge density distribution. The acid molecules may therefore attach more readily to the toner particles than the salt molecules, and upon reacting with the base result in substantially more anions of the salt adhering to the toner particles than attach to the particles when the salt molecules are added directly, as in prior art, to the toner. As a result, the toner particles tend to acquire greater negative charge than by directly adding the CD salt molecules to the toner.

The above theory as to why charging toner particles in a liquid toner using an acid and base, in accordance with an embodiment of the invention, provides improved charging of the toner particles is not definitive or necessarily exclusive, and is not intended as a limitation of the present invention, unless specifically claimed in a particular claim. Other mechanisms in addition to, or instead of, the posited mechanism suggested above may participate in enhancing charging, in accordance with an embodiment of the invention.

In the detailed description certain toner polymers and toner polymer mixtures are described. These polymers and mixtures are purely exemplary. Other toner polymer materials, especially those that are formed by an acid and base and in which one of a cation or anion remain attached to the toner and the other of the cation and anion dissolve in the carrier liquid, should give improved charging, except at low levels of charging. Examples of toner materials suitable for use in the present invention can be found in the prior art listed in the background section, although, as indicated above, the charging of many toner particles having various polymer constituents can be expected to give good or at least passable results.

Furthermore, while the detailed description section describes exemplary negative toner particles, toner particles comprising a polymer, having amine moieties in general exhibit a proclivity to acquire positive charge. Examples of polymers having amine moieties are Acryloid DM 55, acrylic resin containing tertiary amino groups, marketed by Rohm and Haas, and Macromelt 6239, amino terminated polyamide marketed by Henkel. It is expected that such toner particles and other toner particles having a tendency to acquire positive charge may be positively charged more efficiently than in prior art using a process in accordance with an embodiment of the invention similar to that used to charge toner particles comprising carboxylic acid moieties with a negative charge. However, in charging toner particles with a positive charge in accordance with an embodiment of the invention, a suitable base is first added to the toner followed by an acid. Optionally the base is chosen from the group of bases consisting of mono and bi-valent and tri-valent metal hydroxides or amines with hydrocarbonic background that are soluble in the toner carrier liquid. Optionally, the acid is a phosphoric acid derivative, such as Bis(2-ethyl hexyl)hydrogen phosphate, or sulfuric acid derivative.

There is thus provided, in accordance with an exemplary embodiment of the invention, a method of charging toner particles in a liquid toner comprising:

mixing the toner with an acid; and mixing the toner with a base that reacts with the acid to charge the toner particles.

Optionally, the acid is added to the toner first and the base subsequently to charge the toner particles with a negative charge.

In an embodiment of the invention, the acid comprises a sulfonic or carboxylic acid. Optionally, the acid is chosen from the group consisting of: dodecyl benzene sulfonic acid (DDBS), Bis(2-ethylhexyl)sulfosuccinic acid (AOT) and dinonyl naphthalene sulfonic acid (DNNS).

In an embodiment of the invention, the base comprises an amine. Optionally, the amine is chosen from the group consisting of: 2-ethylhexyl amine, triethyl amine, diethyl amine and 2-ethylhexyl amine.

In an embodiment of the invention, the base comprises a metal hydroxide. Optionally, the metal hydroxide is a monovalent or bivalent metal hydroxide. Optionally, the base comprises basic barium petronate (BBP).

In a embodiment of the invention, the base comprises barium dinonyl naphthalene sulfonate hydroxide salt (DNNS BaOH).

In an embodiment of the invention, the toner particles comprise a polymer having a carboxylic acid moiety.

In an embodiment of the invention, the base is added first and the acid subsequently to charge the toner particles with a positive charge.

Optionally, the base comprises a mono, bi or trivalent metal hydroxide soluble in the toner.

Optionally, the acid comprises a phosphoric acid derivative or a sulfuric acid derivative soluble in the toner.

Optionally, the toner particles comprise a polymer having a carboxylic acid moiety.

DETAILED DESCRIPTION OF EXEMPLARY EMBODIMENTS

A liquid toner for which toner particles comprised therein are to be charged in accordance with an embodiment of the invention may be prepared using any of various methods known in the art. Typically, a thermoplastic polymer, such as, optionally, Nucrel 699 (Ethylene acrylic acid and methacrylic acid copolymer resin) manufactured by Du Pont, is mixed with a carrier liquid, for example Isopar-L (Isoparaphinic synthetic liquid) manufactured by EXXON, at elevated temperature (e.g. 120° C.-130° C.) to form a slurry of the carrier liquid and polymer toner particles plasticized with the carrier liquid. The slurry is allowed to cool and carrier liquid generally added to dilute the slurry so that it comprises, for example, between 10-40% by weight of solids. Pigments or dyes are optionally added to provide the toner particles with a desired color and the mixture is loaded into a ball mill and ground at relatively low temperature, between about 40° C. to about 60° C., until the toner particles have a desired size and are uniformly dispersed in the carrier liquid at a desired particle density. During grinding a charge adjuvant such as aluminum alkoxide, aluminum or magnesium stearate or octoate, or an oxide such as silica, alumina or titania is often added to the toner to promote charging of the toner particles. Following grinding, the liquid toner is allowed to cool to room temperature.

In the prior art a charge director is added to and mixed with the toner to percolate the charge director through the toner. The toner is then left to sit for a sufficient period of time for the charge director to charge the toner particles. The charge director is often a salt such as, 2-ethylhexyl ammonium AOT, 2-ethylhexyl ammonium DDBS or DNNS Ba DDBS. The toner is further diluted as may be needed for storage or printing. For storage, the toner may be diluted to about 20% by weight of non-volatile solids (NVS). Immediately prior to use, the concentrate is typically diluted with additional carrier liquid to a concentration of about 1% to about 2.5% by weight of NVS. Optionally a small amount of Teflon particles are added to the toner to improve durability.

In accordance with an embodiment of the invention, toner is charged by adding to the toner, optionally after the grinding stage, an acid and preferably mixing the toner and acid mixture to percolate the acid through the toner. A base, which reacts with the acid to form an acid salt that functions as a charge director is then added to the mixture. The mixture is preferably mixed to percolate the base through the toner and then the toner left for period of time sufficient for the base to react with the acid and charge thereby the toner particles.

The inventors carried out a number of different experiments to determine the efficacy of charging toner particles in accordance with embodiments of the invention relative to charging in accordance with prior art. Table 1 below entitled, "CHARGING WITH A SALT AND WITH AN ACID & BASE", presents, by way of example, results of charging toner particles based on certain polymers comprised in liquid toners. The toners defined below are designated as types A and B respectively, with a prefix that is a color identifier (CMYK), in accordance with an embodiment of the present invention. Toner types A and B have toner particles comprising a polymer, based on ethylene acrylic acid copolymers that comprise carboxylic acid moieties and have a tendency to charge negatively.

In general, the toners are formed with fibrous extensions, although other toners can also be charged by the methods and materials of the invention.

For each toner in Table 1, and each of a plurality of different salts usable as a CD, a first quantity of the toner was charged in accordance with prior art by adding a quantity of a "charge directing" salt to the toner in an amount equal to 50 milligrams per gram toner NVS (mg/g-NVS). The toner and salt mixture was mixed for about 1 hour to percolate the salt through the mixture and then the mixture was allowed to sit at room temperature for a period of time sufficient for the salt to charge the toner particles in the toner. A second quantity of the toner was charged, in accordance with an embodiment of the invention, by mixing an acid with the toner and then mixing with the toner/acid mixture a base that reacts with the acid to form the salt.

In accordance with an embodiment of the invention, the acid was mixed with the toner for about an hour before the base was added, although shorter or longer times may be used. After adding the base, and mixing to percolate the base through the toner, the toner was allowed to sit at room temperature to allow the base and acid to react and charge the toner particles in the toner. The quantities of acid and base added to the second quantity of toner were such as to produce about 50 mg of the salt per grain NVS in the toner.

To compare charging the toner in accordance with an embodiment of the present invention relative to charging with the salt, the conductivities of the toner ascribed to charge accumulated by toner particles after charging in each case were measured using methods known in the art and a ratio of the conductivities determined. Apparatus and method for measuring conductivity of a liquid such as a liquid toner are described in PCT Application PCT/IL03/00866 filed on Oct. 23, 2003, the disclosure of which is incorporated herein by reference.

For each toner, the column labeled SALT in Table 1 gives the names of the salts used to charge the toner in accordance with prior art. For a given salt listed in the table, the column labeled "ACID/BASE" in the table gives the corresponding acid and base used to charge the toner in accordance with an embodiment of the present invention. The toner particle conductivities of the charged toner for charging with the salt and the acid and base are given in pico Siemens/cm (pS/cm) in the columns titled "PC SALT" and "PC A/B" respectively. The column titled "T" gives a time interval, in hours (h) or days (d), following a time at which the salt was added to charge the toner in accordance with prior art, and after addition of the base to charge the toner in accordance with an embodiment of the invention, at which conductivity measurements for the toner were made. The column titled "R" gives the ratio between the particle conductivities, which is a measure of the enhanced charging provided by an embodiment of the present invention, relative to prior art.

Table 1 shows that for each case, charging the toner in accordance with an embodiment of the present invention provides substantially enhanced particle conductivity, as indicated by the ratio R, relative to particle conductivity achieved by charging directly with the salt. The enhancement is particularly large for salts, which when used alone provide a relatively low particle conductivity for a toner. For example, note for toner K-B the salts, DNNS Ba DDBS, DNNS Ba DNNS, diethyl ammonium DNNS and triethyl ammonium DNNS. For salts that provide a relatively high conductivity, the enhancement, whereas not as pronounced as that for "low conductivity" salts, is still substantial.

Table 1 also shows that particle conductivity provided by charging a toner with a given salt and enhancement provided by charging the toner with the corresponding acid and base, in accordance with an embodiment of the invention, can be strongly dependent on the toner. Not shown in Table 1 are results of experiments carried out by the inventors in which, instead of first adding and mixing the acid to the toner and then adding and mixing the base, first the base was added and mixed with the toner and then the acid added and mixed. For these "reverse" mixing procedures, there was substantially no enhancement of toner particle conductivity for toners K3.2 and Y3.1 and particle conductivities were in general about the same or less than corresponding particle conductivities achieved by charging directly with the salt.

TABLE 1

CHARGING WITH A SALT AND WITH AN ACID & BASE

| SALT | ACID/BASE | T | PC SALT | PC A/B | R |
|---|---|---|---|---|---|
| TONER = KB | | | | | |
| 2-ethylhexyl ammonium AOT | AOT/2-ethylhexyl amine | 18 h | 14 | 51 | 3.64 |
| 2-ethylhexyl ammonium AOT | AOT/2-ethylhexyl amine | 30 d | 14 | 35 | 2.50 |
| Triethyl ammonium AOT | AOT/triethyl amine | 18 h | 35 | 95 | 2.71 |
| Triethyl ammonium AOT | AOT/triethyl amine | 30 d | 40 | 93 | 2.33 |
| Diethyl ammonium AOT | AOT/diethyl amine | 30 d | 89 | 183 | 2.06 |
| Diethyl ammonium AOT | AOT/diethyl amine | 18 h | 139 | 181 | 1.30 |
| 2-ethylhexyl ammonium DDBS | DDBS/2-ethylhexyl amine | 24 h | 306 | 365 | 1.19 |

TABLE 1-continued

| CHARGING WITH A SALT AND WITH AN ACID & BASE | | | | | |
|---|---|---|---|---|---|
| SALT | ACID/BASE | T | PC SALT | PC A/B | R |
| 2-ethylhexyl ammonium DDBS | DDBS/2-ethylhexyl amine | 8 d | 306 | 392 | 1.28 |
| DNNS Ba DDBS | DDBS/DNNS BaOH | 6 d | 20 | 36 | 1.8 |
| DNNS Ba DNNS | DNNS/DNNS BaOH | 6 d | 4 | 50 | 12.5 |
| Diethyl ammonium DNNS | DNNS/diethyl amine | 24 h | 6 | 43 | 7.17 |
| Diethyl ammonium DNNS | DNNS/diethyl amine | 7 d | 4 | 37 | 9.25 |
| Triethyl ammonium DNNS | DNNS/triethyl amine | 24 h | 7 | 33 | 4.71 |
| Triethyl ammonium DNNS | DNNS/triethyl amine | 7 d | 7 | 37 | 5.29 |
| | TONER = Y-A | | | | |
| 2-ethylhexyl ammonium AOT | AOT/2-ethylhexyl amine | 18 h | 37 | 307 | 8.30 |
| 2-ethylhexyl ammonium AOT | AOT/2-ethylhexyl amine | 30 d | 42 | 155 | 3.69 |
| Triethyl ammonium AOT | AOT/triethyl amine | 18 h | 56 | 177 | 3.16 |
| Triethyl ammonium AOT | AOT/triethyl amine | 30 d | 69 | 218 | 3.16 |
| Diethyl ammonium AOT | AOT/diethyl amine | 18 h | 131 | 272 | 2.08 |
| Diethyl ammonium AOT | AOT/diethyl amine | 30 d | 151 | 317 | 2.10 |
| 2-ethylhexyl ammonium DDBS | DDBS/2-ethylhexyl amine | 48 h | 210 | 351 | 1.67 |
| 2-ethylhexyl ammonium DDBS | DDBS/2-ethylhexyl amine | 4 d | 218 | 361 | 1.66 |
| DNNS Ba DDBS | DDBS/DNNS BaOH | 6 d | 129 | 206 | 1.6 |
| Diethyl ammonium DNNS | DNNS/diethyl amine | 24 H | 75 | 224 | 2.99 |
| Diethyl ammonium DNNS | DNNS/diethyl amine | 7 D | 34 | 159 | 4.68 |
| Triethyl ammonium DNNS | DNNS/triethyl amine | 24 h | 69 | 130 | 1.88 |
| Triethyl ammonium DNNS | DNNS/triethyl amine | 7 d | 49 | 101 | 2.06 |

For the salt 2-ethylhexyl ammonium DDBS, which provides the highest particle conductivity for both K-B and Y-A, the inventors have performed experiments to investigate toner conductivity provided by the salt when charging different toners in accordance with the invention using different quantities of the salt and corresponding quantities of acid and base.

Table 2 below presents results of charging toner particles A and B comprised in different liquid toners, in accordance with an embodiment of the present invention. Entries in Table 2 in a first column of the table titled "TONER" identify the different toners. For each toner, a quantity of the toner was charged in accordance with prior art by adding different quantities of the salt 2-ethylhexyl ammonium (DDBS) to the toner and mixing for 24 hours at room temperature. In each case, a column labeled "CHARGING LEVEL" gives an amount of the salt, in mg/g-NVS of the toner, added to the toner to charge the toner particles.

Charging levels of 10, 30 and 50 mg/g-NVS of the salt were used to charge each toner listed in Table 2 except for toners Y-A and Y-B, which were charged only with 50 mg/g-NVS of the salt. For each charging level and for each toner, a column headed "T" gives times at which conductivity of the toner was measured in hours or days following a time at which the toner was charged. A column labeled "PC SALT" gives the particle conductivity of the toner in pS/cm due to mobility of the toner particles in the toner, which was measured at the time shown in the T column for the charging level shown in the CHARGING LEVEL column.

A column labeled "PC ACID/BASE" gives the particle conductivity of the toner charged in accordance with the invention by adding to the toner first dodecylbenzene sulfonic acid (DDBS) and then 2-ethylhexyl amine. The quantities of acid and amine added in each case are quantities that react to provide a quantity of the salt noted in the column labeled "CHARGING LEVEL". A column labeled "R" shows for each case the ratio of particle conductivity provided by inventive charging using an acid and base relative to conductivity provided by control charging, using a salt formed by the reaction of the acid and the base.

TABLE 2

| CONDUCTIVITY RATIO R as FUNCTION of CHARGING & TONER | | | | | |
|---|---|---|---|---|---|
| TONER | T | CHARGING LEVEL | PC SALT | PC Acid & Base | R |
| K-B | 3 | 10 | 155 | 132 | 0.85 |
| | 3 | 30 | 240 | 233 | 0.97 |
| | 3 | 50 | 240 | 297 | 1.24 |
| | 1 d | 10 | 181 | 114 | 0.63 |
| | 1 d | 30 | 259 | 264 | 1.02 |
| | 1 d | 50 | 306 | 364 | 1.19 |
| | 8 d | 10 | 140 | 100 | 0.71 |
| | 8 d | 30 | 263 | 292 | 1.11 |
| | 8 d | 50 | 306 | 392 | 1.28 |
| M-B | 16 | 10 | 44 | 56 | 1.27 |
| | 16 | 30 | 138 | 258 | 1.87 |
| | 16 | 50 | 175 | 393 | 2.25 |
| | 2 d | 10 | 44 | 51 | 1.16 |
| | 2 d | 30 | 150 | 258 | 1.72 |
| | 2 d | 50 | 197 | 406 | 2.06 |
| | 8 d | 10 | 21 | 43 | 2.05 |
| | 8 d | 30 | 163 | 294 | 1.80 |
| | 8 d | 50 | 217 | 425 | 1.96 |
| C-B | 17 h | 10 | 198 | 165 | 0.83 |
| | 17 h | 30 | 214 | 318 | 1.49 |
| | 17 h | 50 | 250 | 413 | 1.65 |
| | 1 d | 10 | 158 | 145 | 0.92 |
| | 1 d | 30 | 200 | 306 | 1.53 |
| | 1 d | 50 | 240 | 422 | 1.76 |
| | 7 d | 10 | 147 | 138 | 0.94 |
| | 7 d | 30 | 156 | 320 | 2.05 |
| | 7 d | 50 | 238 | 405 | 1.70 |
| Y-B | 1 d | 50 | 33 | 87 | 2.64 |
| | 2 d | 50 | 33 | 68 | 2.06 |
| Y-A | 2 d | 50 | 210 | 351 | 1.67 |
| | 4 d | 50 | 218 | 361 | 1.66 |

From Table 2 it is seen that R is, in general, greater than one at least for concentrations of interest (higher concentrations) and charge increases as the amount of charge director increases.

For the experiments whose results are given above, representative toners were manufactured by the following processes.

To produce K-A toner, 7.5 kg of Nucrel 699 (du Pont), and 7.5 kg Isopar L (Exxon) are mixed for 1 hour at speed 2 in a Ross double planetary mixture for one hour, at a controlled temperature of 150 degrees C., followed by the addition of 15 kg Isopar, preheated to 90 deg C. and further mixing at speed 5 for 1 hour. The mixture is cooled to room temperature while mixing at speed 3. 140 g of the of the cooled were transferred to S0 attritor (Union Process Inc., Akron, Ohio) charged with ¼ inch carbon steel balls together with 9.3 g carbon black Mogul L (Cabot); 1.9 grain alkali blue, 0.46 grain aluminum stearate and 50 gram Isopar L. The mixture was ground for 24 hours at 250 rpm. The ground mixture was diluted with Isopar L to 2% solids and subjected to the charging trials.

To produce Y-B toner, 6 kg of Nucrel 699, 1.5 kg of Aclyn 5120 (Allied) and 7.5 kg Isopar L are mixed for 1 hour at speed 2 in a Ross double planetary mixture for one hour, at a controlled temperature of 150 degrees C., followed by the addition of 15 kg Isopar, preheated to 90 deg C. and further mixing at speed 5 for 1 hour. The mixture is cooled to room temperature while mixing at speed 3. 140 g of the mixture were transferred to S0 attritor (Union Process Inc., Akron, Ohio) charged with ¼ inch carbon steel balls, together with 4.7 g Paliotol yellow D1155 (BASF); 1.2 g Paliotol D 1819 (BASF); 1.4 g aluminum stearate and 50 g Isopar L. The mixture was ground for 24 hours at 250 rpm. The ground mixture was diluted with Isopar L to 2% solids and subjected to the charging trials.

Toners having different colors are prepared using different pigments, as known in the art in place of the pigments used in making K-A and Y-B toners.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art. The scope of the invention is limited only by the following claims.

The invention claimed is:

1. A method of charging toner particles in a liquid toner comprising:

mixing the toner with an acid; and mixing the toner with a base that reacts with the acid to charge the toner particles.

2. A method according to claim 1 wherein the acid is added to the toner first and the base subsequently to charge the toner particles with a negative charge.

3. A method according to claim 2 wherein the acid comprises a sulfonic or carboxylic acid.

4. A method according to claim 3 wherein the acid is chosen from the group consisting of: dodecyl benzene sulfonic acid (DDBS), Bis(2-ethylhexyl) sulfosuccinic acid (AOT) and dinonyl naphthalene sulfonic acid (DNNS).

5. A method according to claim 2 wherein the base comprises an amine.

6. A method according to claim 5 wherein the amine is chosen from the group consisting of: 2-ethylhexyl amine, triethyl amine, diethyl amine and 2-ethylhexyl amine.

7. A method according to claim 2 wherein the base comprises a metal hydroxide.

8. A method according to claim 7 wherein the metal hydroxide is a monovalent or bivalent metal hydroxide.

9. A method according to claim 7 wherein the base comprises basic barium petronate (BBP).

10. A method according to claim 2, wherein the base comprises barium dinonyl naphthalene sulfonate hydroxide salt (DNNS BaOH).

11. A method according to claim 2 wherein the toner particles comprise a polymer having a carboxylic acid moiety.

12. A method according to claim 3 wherein the base comprises an amine.

13. A method according to claim 12 wherein the amine is chosen from the group consisting of: 2-ethylhexyl amine, triethyl amine, diethyl amine and 2-ethylhexyl amine.

14. A method according to claim 4 wherein the base comprises an amine.

15. A method according to claim 14 wherein the amine is chosen from the group consisting of: 2-ethylhexyl amine, triethyl amine, diethyl amine and 2-ethylhexyl amine.

16. A method according to claim 3 wherein the base comprises a metal hydroxide.

17. A method according to claim 16 wherein the metal hydroxide is a monovalent or bivalent metal hydroxide.

18. A method according to claim 16 wherein the base comprises basic barium petronate (BBP).

19. A method according to claim 3, wherein the base comprises barium dinonyl naphthalene sulfonate hydroxide salt (DNNS BaOH).

20. A method according to claim 4 wherein the base comprises a metal hydroxide.

21. A method according to claim 20 wherein the metal hydroxide is a monovalent or bivalent metal hydroxide.

22. A method according to claim 3 wherein the base comprises basic barium petronate (BBP).

23. A method according to claim 4, wherein the base comprises barium dinonyl naphthalene sulfonate hydroxide salt (DNNS BaOH).

* * * * *